US007687693B2

(12) United States Patent
Clark et al.

(10) Patent No.: US 7,687,693 B2
(45) Date of Patent: Mar. 30, 2010

(54) GRAND PIANO COMPOSITE PIANO ACTION

(75) Inventors: Bruce Clark, Nottingkam, NH (US); Kevin Burke, Haverhill, MA (US); Kurk Burgett, Sacramento, CA (US)

(73) Assignee: Wessell, Nickel & Gross

( * ) Notice: Subject to any disclaimer, the term of this patent is extended or adjusted under 35 U.S.C. 154(b) by 179 days.

(21) Appl. No.: 11/762,990

(22) Filed: Jun. 14, 2007

(65) Prior Publication Data

US 2008/0307942 A1 Dec. 18, 2008

(51) Int. Cl.
*G10C 3/18* (2006.01)

(52) U.S. Cl. ..... 84/239; 84/243

(58) Field of Classification Search ..... 84/239, 84/243, 236

See application file for complete search history.

(56) References Cited

U.S. PATENT DOCUMENTS

| | | | | |
|---|---|---|---|---|
| 2,513,191 | A | 6/1950 | Martin | |
| 2,610,358 | A | 9/1952 | Martin | |
| 2,881,509 | A | 4/1959 | Gadebusch | |
| 2,948,180 | A | 8/1960 | Wood | |
| 3,240,095 | A | 3/1966 | Steinway | |
| 3,545,329 | A | 12/1970 | Roehrig | |
| 3,583,271 | A | 6/1971 | Corwin | |
| 3,596,553 | A | 8/1971 | Vagias | |
| 3,651,732 | A | 3/1972 | Erbert | |
| 3,651,733 | A * | 3/1972 | Corwin et al. | 84/243 |
| 3,942,403 | A | 3/1976 | Pramberger | |
| 5,911,167 | A * | 6/1999 | Jones et al. | 84/236 |
| 5,932,820 | A | 8/1999 | Kihara | |
| 6,348,645 | B1 | 2/2002 | Yamashita | |
| 6,417,440 | B2 | 7/2002 | Furuki | |
| 6,740,801 | B2 | 5/2004 | Yoshisue | |
| 7,141,728 | B2 * | 11/2006 | Yoshisue et al. | 84/236 |
| 2007/0012156 | A1 * | 1/2007 | Yoshisue et al. | 84/243 |

* cited by examiner

*Primary Examiner*—Jianchun Qin
(74) *Attorney, Agent, or Firm*—Craig A. Simmerman

(57) ABSTRACT

Composite or plastic molded articles used in a grand piano action. A piano action actuates in response to depression on a piano key to swing a hammer into a piano string. The articles are assembled to form a piano action with significantly less dynamic mass which is much more responsive to the touch. In addition, the new action provides the valuable collateral benefits of increased efficiency of manufacture and maintenance. The invention also provides the capability to achieve true half stroke design in both the sharp and white keys. Additionally, the application discloses a universal composite grand piano action that is capable of being installed into any brand of grand piano.

4 Claims, 16 Drawing Sheets

15605 grams mm^2

GRAND PIANO COMPOSITE PIANO ACTION

BACKGROUND OF INVENTION

This invention relates to key operated percussion devices such as grand pianos and, more specifically, to the "actions" of such devices. A piano action transmits motion from the pianist's fingers to the piano strings.

The grand piano is a mature product that has remained relatively unchanged for nearly 100 years. Pianists, in general, must spend many years playing a piano in order to develop their technique. As a result, pianists, generally, prefer traditional piano actions because they learned to play on traditional piano actions which have remained unchanged. Traditional piano actions are made of wood. Typically, hornbeam or maple is used.

Relative to more modern materials, such as composites or plastics, wood is an inefficient raw material from which to manufacture piano action components. Wood action pieces must be drilled to produce the holes required for pivotal connections and assembly with other action components. The hole-drilling process is a laborious and costly process as compared to the production of molded piano action pieces with holes accurately formed therein during the initial molding process.

Wood is hydroscopic, i.e. wood swells or shrinks as its moisture content changes in response to the environment. This can cause binding in the action. Additionally, after repeated occurrences, this causes compression of the wood leading to failure of the piano action component. For instance, wood flanges often crack due to expansion from a rise in moisture content, as the screw crushes the wood in the flange where it is fastened to the rail. Moreover, wood has different strengths in different directions, complicating manufacturing processes, also resulting in reduced manufacturing efficiencies. Additionally, the production of any finished wood piece necessarily involves relatively large quantities of wasted material in the form of saw dust, which is inherent in any wood-working process. Finally, the lifespan of wood piano action components is limited as compared to that of other materials such as composites or plastics because wood eventually crumbles into dust after a certain amount of environmental cycles. On the other hand, composite piano action components would eliminated all the preceding drawbacks and result in more efficient manufacture and maintenance of a piano. Composite is defined as an engineered material made from two or more constituent materials with significantly different physical or chemical properties and which remain separate and distinct on a macroscopic level within the finished structure.

Thus far, all but one attempt to use composite piano action components has met with less than satisfactory market acceptance. This is because composite material is heavier than wood. Thus far, manufacturers have simply replaced traditional wood components with similarly designed and shaped composite components, resulting in heavier or, at best, equivalent mass composite action members. Our experimentation shows that, in all cases, current composite grand piano actions do not decrease and generally increase moments of inertia as determined by touch weight on the piano keys.

An increase in overall moment of inertia of a piano action is unacceptable to the pianist. Playing the piano requires a great deal of hand strength. This requirement is amplified when the pianist is playing difficult musical pieces that require the key to respond very quickly for both volume and repetition. It is probably true that virtuosic piano pieces require strength and agility at the very limit of the abilities of the human hand. A pianist who depends on a key to move with a certain amount of finger strength will reject a piano action that requires more strength to produce the same key motion.

U.S. Pat. No. 6,740,801 (Yoshisue I) and U.S. Pat. No. 7,141,728 (Yoshisue II) have met with limited market acceptance. The object of Yoshisue I is to increase the efficiency of manufacture and maintenance and to extend the lifespan of a grand piano action mechanism. In every claim, Yoshisue I is limited to piano actions with at least one component of the action made of "synthetic resin having electrical conductivity at least on the surface thereof". The goal of this limitation is to eliminate static charge, thereby reducing the tendency of foreign particles to adhere to the action members as the particles cause wear, thereby increasing the lifespan of the action mechanism. Yoshisue I did not include the object of reducing the moment of inertia of the piano action. Yoshisue I teaches away from the use of plastic with a non-conductive surface in a piano action.

The object of Yoshisue II is to increase rigidity of the repetition base of the piano action. Increased rigidity can decrease the moments of the action when the rigidity increase is paired with certain changes in centers of mass of rotating action members and reductions in overall mass of certain action members. The repetition base in Yoshisue II, on the other hand, is without substantial change in repetition base center-of-mass and its overall mass is the same or heavier than the counterparts of this invention. Thus, the moment of the repetition base of Yoshisue II and the overall moment the whole piano action is significantly larger than those of this invention. Yoshisue II and this invention may seek to cure the same problem, i.e. reduce the energy requirements to cycle a grand piano action or improve the performance of the action; however, Yoshisue II failed at this object because it failed to discover and address the main source of the problem, which is inertia, dynamic mass, or moment analysis.

OBJECT OF INVENTION

It is an object of this invention to yield a piano action that has less dynamic mass and is thus more responsive. In order to do this, particular attention was paid to component mass as a function of distance from center of mass of the component to the center of rotation of the repetition or center of rotation of the key. Additionally friction forces are addressed and reduced with the introduction of true half stroke design. As a result, the pianist evaluates the piano action as being quicker, lighter, and more responsive. It is also an object of this invention to tie the collateral benefits of increased efficiency of manufacture and maintenance of a piano action made from composite material with the reduced dynamic mass of a grand piano action. It is also an object of this invention to provide a direct replacement for practically any grand piano action.

DEFINITION LIST

DEFINITION LIST

Figure 1:
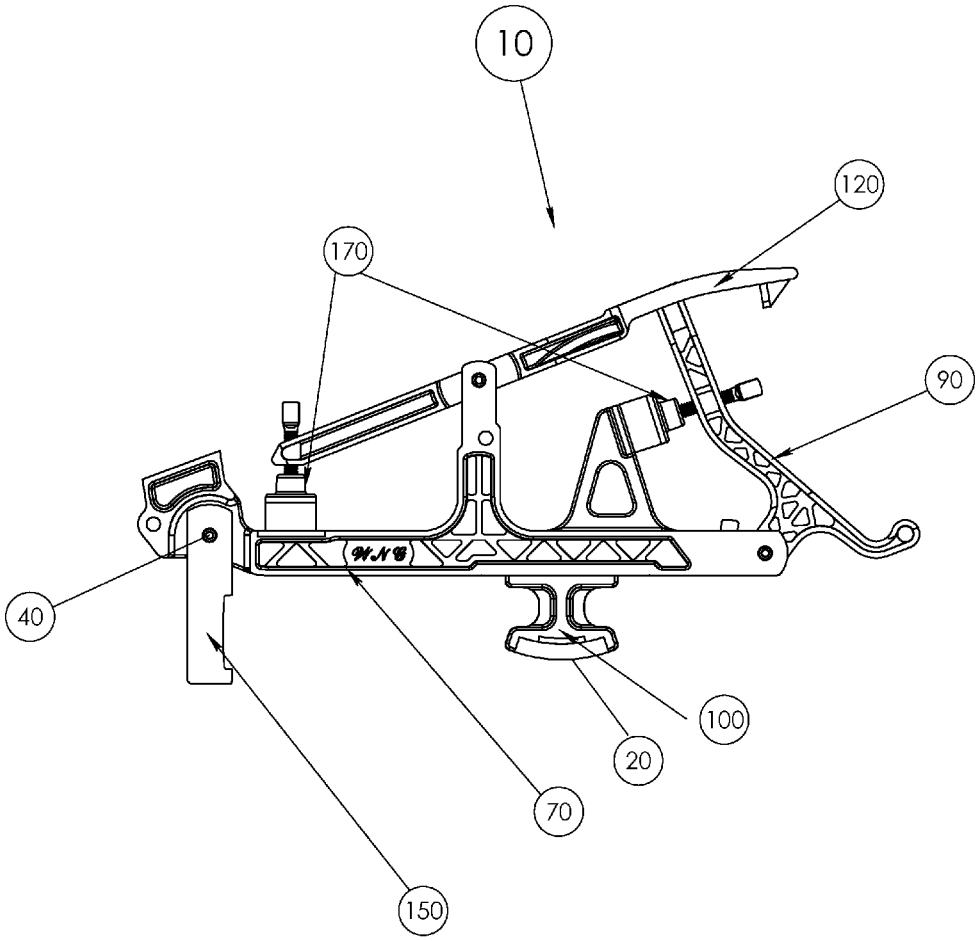
FIG. 1 is a front view of the composite piano action.
Figure 2:
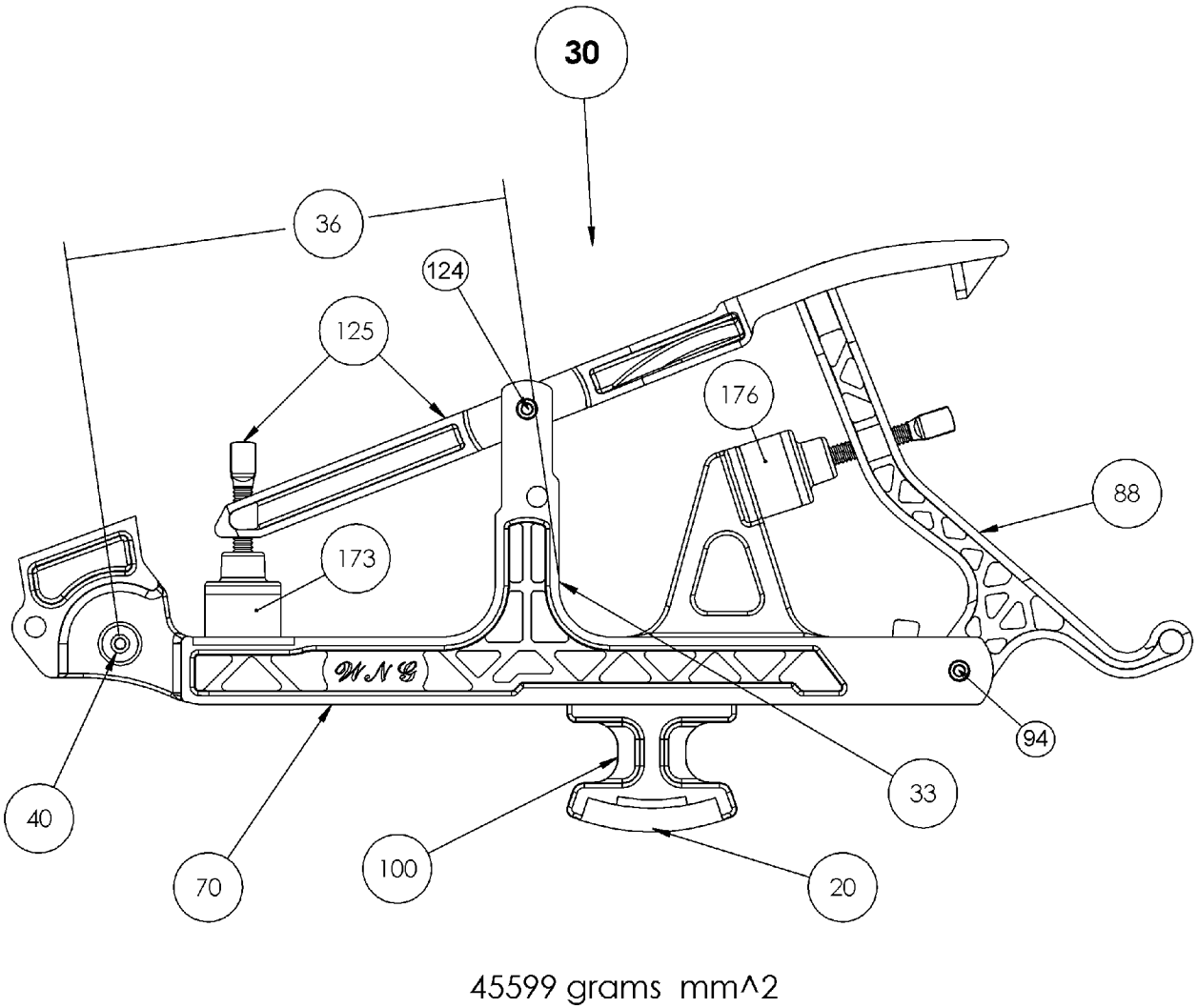
FIG. 2 is a front view of the Repetition Assembly.
Figure 3:
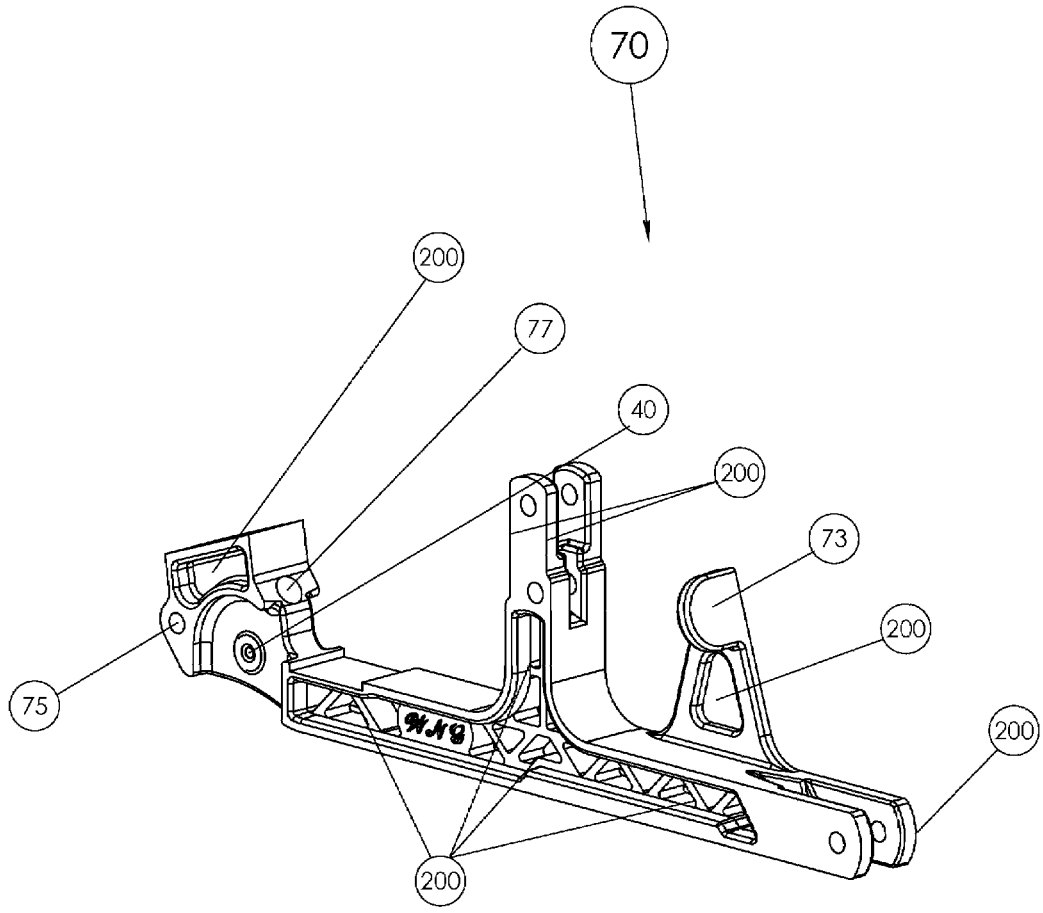
FIG. 3 is a perspective view of the Repetition Base.
Figure 4:
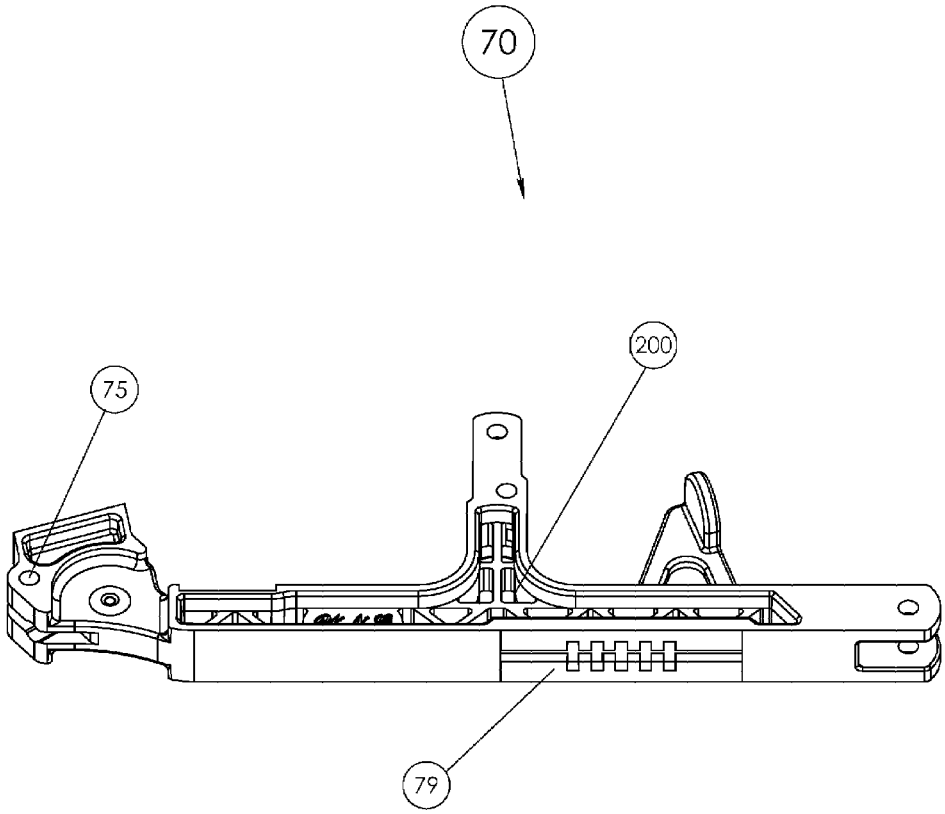
FIG. 4 is a perspective view from a bottom angle of the Repetition Base.
Figure 5:
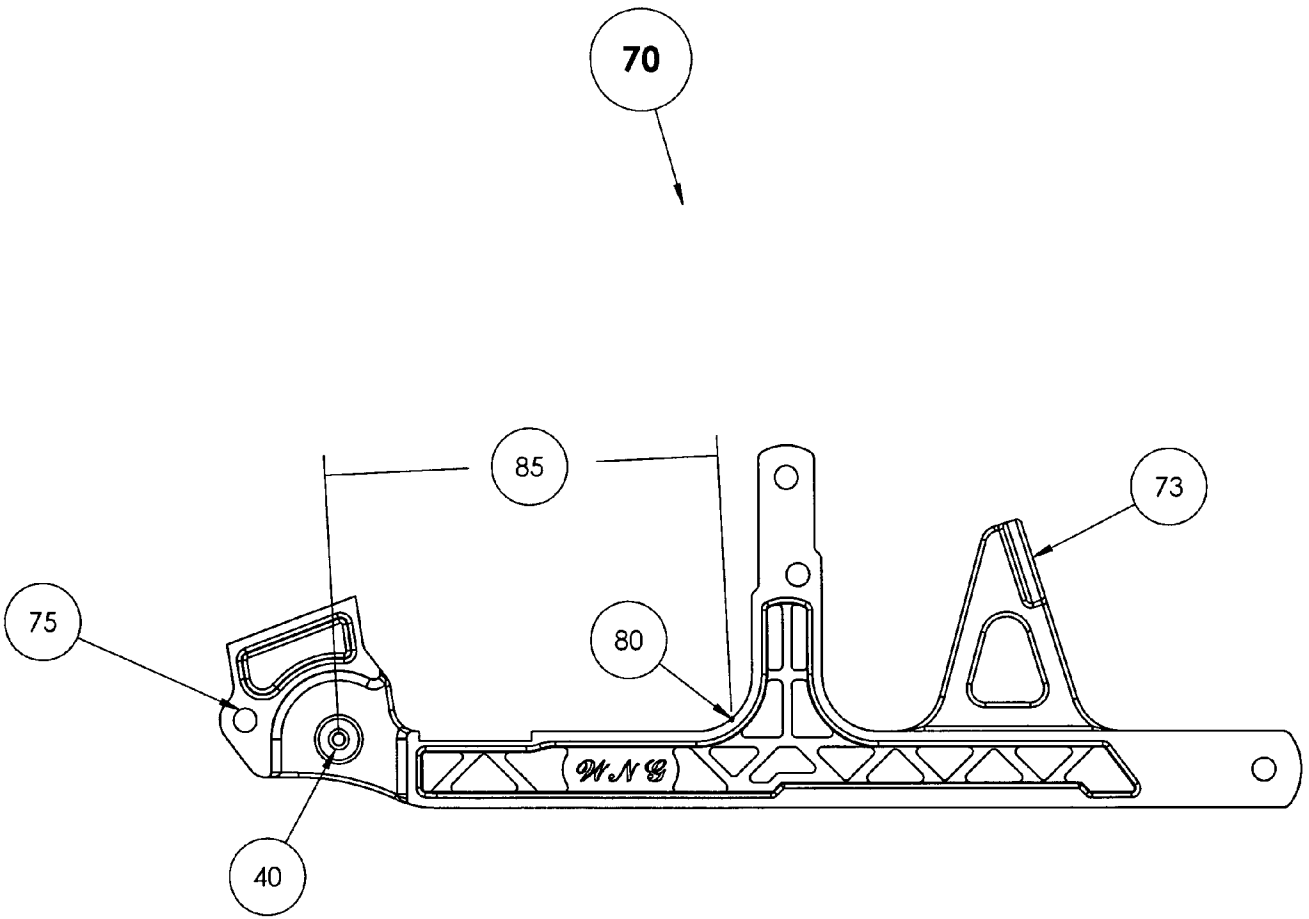
FIG. 5 is a side view of the Repetition Base.
Figure 6:
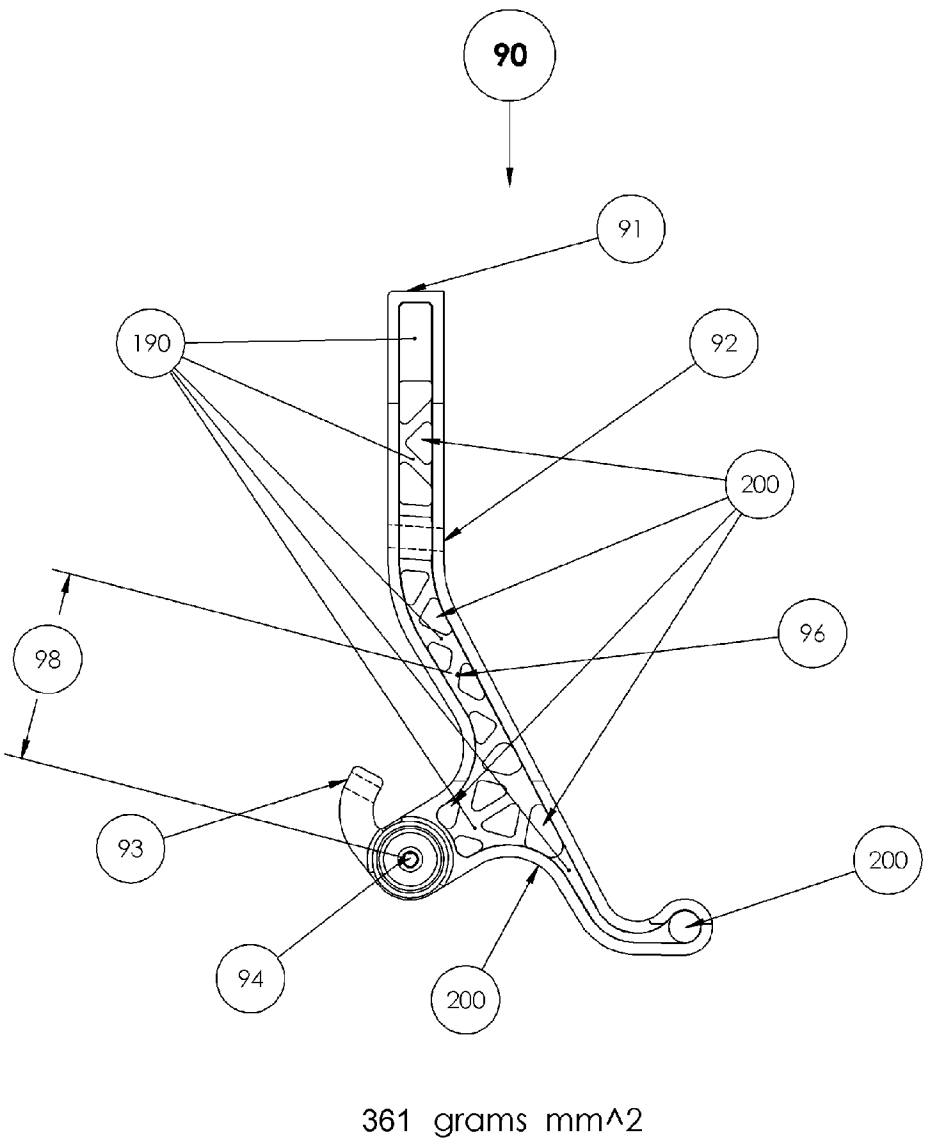
FIG. 6 is a side view of the Jack.
Figure 7:
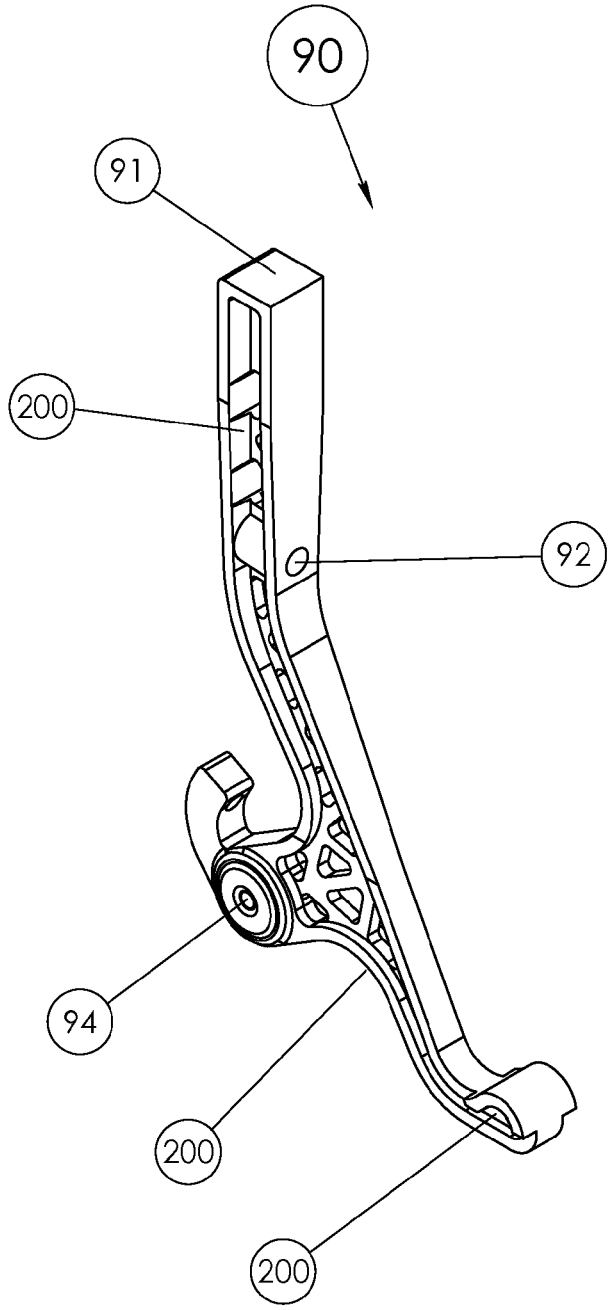
FIG. 7 is a perspective view of the Jack.
Figure 8:
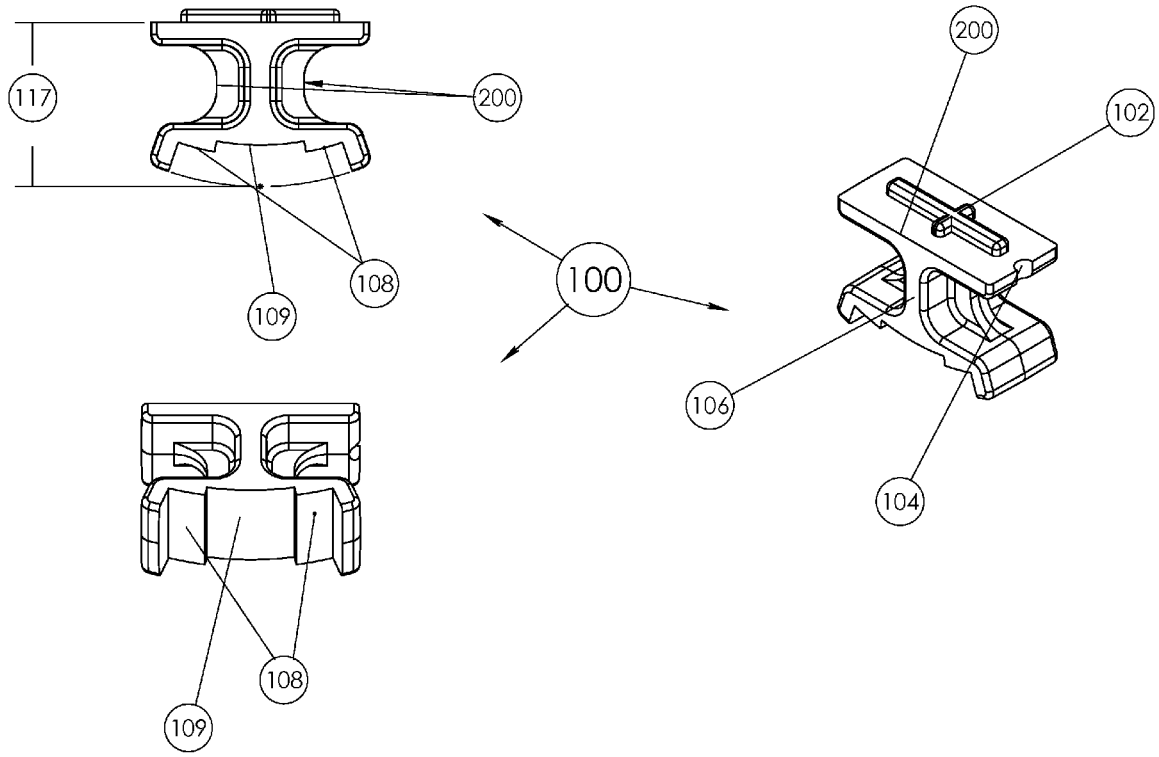
FIG. 8 provides multiple views of the Moveable Multiple Height Heel (MMHH).

| Term | Definition |
|---|---|
| 10 | Composite piano action |
| 20 | Capstan contact point |
| 30 | Repetition Assembly |
| 33 | Repetition Assembly center of mass |
| 36 | Repetition Assembly Effective Radius |
| 40 | Repetition center of rotation |
| 50 | Key |
| 52 | White key capstan contact point at half stroke |
| 54 | White key half stroke line |
| 56 | Sharp key capstan contact point at half stroke |
| 58 | Sharp key half stroke line |
| 60 | Key center of rotation |
| 64 | Sharp key center of rotation |
| 66 | Capstan |
| 70 | Repetition Base |
| 73 | Stop for the Jack Regulating Button (replaces metal spoon) |
| 75 | Hole for "Helper Springs" |
| 77 | Adjustment screw location for "Helper Springs" |
| 79 | Repetition Base Female Notch System |
| 80 | Repetition Base center of mass |
| 85 | Repetition Base Effective Radius |
| 88 | Jack Assembly |
| 90 | Jack |
| 91 | Driving end of Jack |
| 92 | Hole for Jack regulating screw |
| 93 | Hole for Jack Spring |
| 94 | Jack center of rotation |
| 96 | Jack center of mass |
| 98 | Jack Effective Radius |
| 100 | Moveable Multiple Height Heel (MMHH) |
| 102 | Male Notch with offset key location used to connect to Repetition Base |
| 104 | Notch to show orientation |
| 106 | MMHH Central Force Transfer Pillar |
| 108 | Gluing surface for capstan contact cloth |
| 109 | Gluing surface for bushing cloth |
| 110 | Repetition Base with Moveable Multiple Height Heel (MMHH) |
| 112 | Repetition Base with MMHH center of mass |
| 113 | Repetition Base with MMHH Effective Radius |
| 115 | Repetition center of rotation (40) to capstan contact point (20) distance |
| 117 | Height of MMHH |
| 120 | Balancier |
| 122 | No lubricant require here as with wooden actions |
| 123 | Hole for regulating screw |
| 124 | Balancier center of rotation |
| 125 | Balancier Assembly |
| 126 | Balancier thinned to reduce mass |
| 127 | Gluing surface for buckskin |
| 128 | Gluing surface for Jack stop felt |
| 150 | Repetition Flange |
| 152 | Repetition Flange bushed pivot holes |
| 154 | Repetition Flange clearance notch |
| 156 | Repetition Flange screw hole |
| 158 | Repetition Flange "Helper Spring" silk cord notches |
| 160 | Shank Flange |
| 162 | Shank Flange screw hole |
| 164 | Shank Flange drop screw |
| 166 | Shank Flange rail cut |
| 168 | Hammer shank center of rotation |
| 170 | Regulating Button |

-continued

DEFINITION LIST

| Term | Definition |
|---|---|
| 173 | Balancier Regulating Button |
| 176 | Jack Regulating Button |
| 180 | Back Check |
| 181 | Back Check felt gluing surface |
| 182 | Back Check buckskin gluing surface |
| 184 | Back Check felt area length |
| 186 | Back Check length |
| 188 | Back Check mount for back check wire |
| 189 | Back Check hole for check wire |
| 190 | Strategically shaped reinforcement material |
| 200 | Material removed to reduce mass |

DETAILED DESCRIPTION OF EMBODIMENTS

The primary factors affecting dynamic mass of a piano action are: 1) mass of the composite piano action 10 at the capstan contact point 20, 2) moment of inertia of the Repetition Assembly 30 about the Repetition Assembly center of rotation 33, 3) moment of inertia of the Key 50 about the Key center of rotation 60, and 4) mass of the Key 50. The Repetition Assembly 30 is the Repetition Base 70 and the following items assembled to it: Jack Assembly 88, Balancier Assembly 125, and heel 100.

The static weight of the Repetition Assembly 30 at the point where the capstan contacts the cushion on the heel, hereafter known as the capstan contact point 20, is critical to dynamic mass. A mode of this invention has a weight at this point of 14.1 grams. The two prior art equivalents weigh 16.6 grams (Kawai R2) and 21.9 grams (Kawai R1). We have achieved a 15% reduction over prior art composite grand piano actions.

The moment of inertia of a rigid body rotating about a fixed axis is $\int r^2$ dm, where r is the distance from center of rotation to the differential mass point of the body dm. The moment of inertia of a piano action component can be approximated by: (the distance from center of rotation to the center of mass)$^2\times$ (mass).

Thus, the moment of inertia of the Repetition Assembly 30 can be accurately approximated using the distance from Repetition center of rotation 40 to the Repetition Assembly center of mass center of mass 33—hereafter know as Repetition Assembly Effective Radius 36—and the mass of the Repetition Assembly 30. A mode of this invention has a moment of inertia of 45,599 gmm$^2$ from Repetition Assembly mass of 16.6 grams and Repetition Assembly Effective Radius of 52.4 mm.

The moment of inertia of the key is hard to calculate because it changes throughout the piano. The main factor affecting moment of inertia of the key is the number of leads added to the front of the key to balance the weight on the back end of the key from the hammers that hit the piano strings. Hammers decrease in weight from the bass to the treble as the mass needed to actuate the strings decreases due to the length of the strings and the frequency of the note. So, there are more leads in the bass keys of a piano than the treble keys. Typically there are 2 to 7 leads of ½" diameter in the bass going to 0 to 1 in the treble. The number of leads in the key is also the primary factor affecting the static weight of the key.

Thus, reducing lead count in the key is the metric we use with this invention to gauge the moment of inertia of the key 50 as well as the static weight of the Key 50. This invention on average lowers the lead count in keys by 2-4 leads.

In order to help describe the invention further, the inventors have divided the components of this invention into three groups. Different goals were used with the development of the components in each group.

Group 1

Group 1 components are largely irrelevant to the moment of inertia of the piano action 10, comprising: Repetition Flange 150, and Shank Flange 160. These parts are fixed in space and do not rotate. The Repetition Flange 150 provides secures the Repetition Base center of rotation 40. The Shank Flange 160 secures the hammer. A flange is attached, by a screw, to a rail and thus rendered unmovable. Mass and inertia is not relevant to the performance a flange, as with all of Group 1.

The primary material requirements for these parts are strength, rigidity, stability, and lifespan. In this case, the traditional material of Maple or Hornbeam has been replaced by a composite material.

The best mode composite material is Nylon because Nylon has the highest tensile strength among composites and is also more conducive to gluing. Felt and buckskin must be attached to some action components to function. Additionally, the best mode composite material has glass filler because the glass increases tensile strength of the material. Both glass filled and unfilled composite materials have a non-conductive surface. Combining these two modes, we have determined that the overall best mode material is Nylon 6/6 40% glass filled because of its superior tensile strength and conduciveness to gluing. Maple has a tensile strength of approximately 2500 $lbs/in^2$. Nylon 6/6 40% glass filled has a tensile strength of approximately 8,000 $lbs/in^2$.

Additionally, Group 1 is a direct replacement for their wood counterparts in practically any grand piano.

Group 2

Group 2 components are substantially relevant to the moment of inertia of the Repetition Assembly 30, comprising: Regulating Button 170, Jack 90, Balancier 120, and Back Check 180. The parts in Group 2 all rotate about the Repetition Base center of rotation 40 or the Key center of rotation 60. The center of mass of these components is a significant distance from the relevant center of rotation. The mass of this group of parts is felt dynamically by the pianist as part of the touch weight of the piano. Less mass is better to the limit where the part is no longer structurally sufficient for the task of vigorous piano playing. Group 2 includes the same material qualities as Group 1. Group 2 is also fully interchangeable with traditional wood counterparts.

Structural design of each Group 2 component is quite different from that of their traditional wood counterparts. A concerted effort was taken to remove volume/material from the part, at the proper balance with rigidity requirements, and specifically removing volume furthest from the relevant center of rotation.

The Regulating Button 170 uses the increased strength of composite material to make a part that would not be possible with wood. With the increased tensile strength, we were able to produce a Regulating Button 170 with a base member with T-shaped cross section that provides material only where it is needed. Wherever substantial material was "removed by design" from the traditionally shaped grand piano action component, it is designated by 200 on the drawings. Material removed to reduce mass has resulted in substantial weight reduction of the Regulating Button 170. As with traditional regulating buttons, felt material or other cushion material is glued to the base member with T-shaped cross section to yield a Regulating Button 170.

A Regulating Button 170 of this invention weights 0.18 grams. Prior art composite regulating buttons range from 0.30 (Kawai R2) to 0.40 (Kawai R1) grams. In comparison, with our lightest competitor we have achieved a 40% reduction in mass over prior art composite regulating buttons.

Regulating Buttons 170 are used in two locations: at the Balancier 173 and at the Jack 176. The Regulating Button on the Jack 176 is more critical. Less mass on the Jack 90 is important because the Jack 90 is a relative large action component that is located far from the Repetition center of rotation 40. Any mass reduction in the Jack Regulating Button 176 will yield an exponential reduction in the moment of inertia of the Repetition Assembly 30. The Jack Regulating Button 176 and the Balancier Regulating Button 173 are the same design. The Jack Assembly 88 is defined as the Jack 90 with Jack Regulating Button 176 assembled to it. The Balancier Assembly 125 is defined as the Balancier 120 with Balancier Regulating Button 173 assembled to it.

The Jack 90 of this invention could not be made from wood. A traditional wood jack is made from two pieces of wood with a glued joint to connect the two pieces in an L shape. This glue joint is a common point of failure as the parts age. Two piece jacks were required because of the limited properties of wood. A one-piece wood jack that meets rigidity requirements would be too thick. The thick heavy jack would make the action too heavy and the pianist would reject the heavy "feel" of the action.

Our new Jack 90 is a dramatic departure. It is a one-piece composite component. The shape follows the function of the Jack without compromise, meaning that the new shape optimally applies torque on the Balancier 120 in the most efficient right-angle direction, as the two components rotate about the Repetition center of rotation 40. A similarly shaped wood counterpart would be impractically expensive to produce and would fail anyway, for want of rigidity. Our design allows a substantial reduction of material at various points 200 in the Jack 90, thus substantially lightening the component, while leaving strategically shaped material 190 to provide increased rigidity over traditional wood jacks. The superior strength of the composite material along with the fact that it is strong in all directions allows a one-piece Jack design that is lighter and better. Note that even though the shape of the Jack 90 is drastically different from that of the traditional wood grand piano jack, this component is a direct replacement with most grand pianos.

The moment of inertia of the Jack 90 can be accurately approximated using the distance from Jack center of rotation 94 to the Jack center of mass center of mass 96—hereafter know as Jack Effective Radius 98—and the mass of the Jack 90. This invention has a Jack moment of inertia of 361 $gmm^2$ from Jack mass of 1.3 grams and Jack Effective Radius of 17.0 mm.

The Balancier 120 of this invention is somewhat similar in shape to its traditional wood counterpart, but the Balancier 120 still has many advantages. It has been thinned substantially at various locations 126 to reduce mass even though the overall part is only minimally lighter. Also, composite material slides smoothly at 122 about the Knuckle without lubricants while traditional wood balanciers require lubricant at that point. Lubricants inevitably wear off leaving the potential for excessive friction at the knuckle and poor functioning of the action which is perceived by the pianist as added touch weight. Additionally, the best mode material is conducive to gluing and is required at 127 and 128.

The Balancier is 2.4 grams. Prior art composite balanciers range from 2.5 grams (Kawai R1) to 4.4 grams (Kawai R2). In comparison, with our lightest competitor we have achieved a 4% reduction in mass over prior art composite balanciers.

The Back Check 180 is mounted on the Key 50. The mass of the Back Check 180 must be calibrated to balance the weight exactly on each side of the Key 50. Any reduction in mass of the Back Check 180 will allow the removal of weight on the front of the Key 50, thus producing a reduction in touch resistance of the piano action.

Our new Back Check 180, as designed, could not be made from wood. The traditional back check is a solid block of wood that is longer and wider than the Back Check 180 of this invention. Older back checks were designed for a wide range of "checking heights". Our Back Check 180 has a more narrow checking range as we believe there is no reason to have capability for such long checking distances anymore.

The Back Check 180 is 23 mm long at 186. A traditional back check is about 29 mm long. Our Back Check 180 has a felt area 182 that is 12 mm long. A traditional back check has felt area about that is 17 mm long.

A traditional back check uses a soft felt under buckskin to provide a cushioned catcher for the hammer after the blow to the string. This results in an unpredictable stopping point on the check. Our new Back Check 180 uses a felt that is considerably more dense under the buckskin. This felt compresses less during checking so it provides a straighter inclined plane for the hammer to catch upon. As a result, the hammer comes to a sliding wedging stop. The result is more precise checking, that is, the hammer is stopped at a more consistent height among repetitions. Additionally, the reduced amount of felt and buckskin significantly reduces overall mass of the Back Check with felt and buckskin.

The Back Check 180 is 0.9 grams. Prior art composite back checks range from 1.2 (Kawai R2) grams to 1.5 grams (Kawai R1). In comparison, with our lightest competitor we have achieved a 25% reduction in mass over prior art back checks.

Group 3

Group 3 components are critically relevant to the moment of inertia of the piano action 10, comprising: Repetition Base 70 and Multiple Height Moveable Heel 100. Group 3 components rotate about the Repetition center of rotation 40. Much of the mass associated with this Group of parts is a significant distance from the Repetition center of rotation 40. The mass of this group of parts is drastically felt by the pianist as the primary component of the touch weight of the piano key. Less mass is better as long as structural requirements are met. Group 3 includes the same material qualities as Group 1. Group 3 is also fully interchangeable with traditional wood counterparts.

The Repetition Base 70 is not lighter than its wood counterparts, however, the Repetition Assembly's (30) moment of inertia is substantially less than that of its wood counterparts. Much of the weight of this part is in the bumper block right above the center of rotation 40 and is thus largely irrelevant. Mass furthest away from the center of rotation 40, however, has been substantially reduced.

Material was removed at strategic locations 200 in the Repetition Base 70, thus substantially lightening the component, while leaving strategically shaped material to provide increased rigidity over traditional wood repetitions.

We have integrated the Stop for the Jack Regulating Button 73 into the Repetition Base 70. Traditionally, a repetition has a metal spoon that acts as a stop for the Jack Regulating Button 176. This integration allows the Jack to be more strategically positioned below the Knuckle and Balancier center of rotation 124. Because a metal spoon is much heavier than either plastic or wood, we have integrated this stop into the composite part. In absolute terms this saves weight but the location of the weight loss is also important as a spoon is located far from the Repetition center of rotation 40. The integration saves weight, reduces parts count, and streamlines manufacturing.

One mode of the invention includes "whippen helper springs". This mode includes a spring that takes weight off the capstan. The spring is attached to the Repetition Base at 75. The mode includes a screw adjustment for the spring tension at 77.

The moment of inertia of the Repetition Base 70 can be accurately approximated using the distance from Repetition center of rotation 40 to the Repetition Base center of mass center of mass 80—hereafter know as Repetition Base Effective Radius 85—and the mass of the Repetition Base 70. A mode of this invention has a measure of 15,605 $gmm^2$ from a Repetition weight of 8.8 grams and Repetition Effective Radius of 42.1 mm.

The bottom of the Repetition Base 70 is designed so that the Moveable Multiple Height Heel 100 can be installed in a variety of positions onto the Repetition Base 70. The bottom of the Repetition Base 70 has female notches spaced at 3 mm located at 79. The corresponding male notch 102 in the Multiple Height Moveable Heel 100 is offset from the center of the part by 1.5 mm thus allowing the MMHH 100 to be attached in a variety of positions in 1.5 mm increments (by turning the MMHH around) along the length of the Repetition Base 100. This allows the Repetition Assembly 10 to be customized to fit in a variety of non standard pianos.

The moment of inertia of the Repetition with MMHH 110 can be accurately approximated using the distance from Repetition center of rotation to the Repetition with MMHH center of mass center of mass 112—hereafter know as Repetition with MMHH Effective Radius 113—and the mass of the Repetition with MMHH. A mode of this invention has a measure of 20,951 $gmm^2$ from a Repetition with MMHH weight of 10.4 grams and Repetition with MMHH Effective Radius of 44.9 mm.

The Multiple Height Moveable Heel 100 allows an unprecedented high degree of control over the location of the capstan contact point 20 on the MMHH 100. The best mode of the MMHH provides eight different length options—12 mm through 18 mm in 1 mm increments. There is also a 20 mm mode.

The MMHH allows for keyboards to be "tuned" to proper "half stroke line", i.e. allows the sharp and white keys to simultaneously attain proper "half stroke line". This is not achievable with prior art piano actions.

Because the key and the repetition both move in separate arcs, their movement must be analyzed as a system in order to view the overall motion of the piano action 10. The key and the repetition could be thought of as one teeter totter on the end of another larger teeter totter. The larger teeter totter is the key. The dynamics of the system will yield the optimum "feel" for the pianist when friction forces are minimized. In this system, friction is minimized when the key is on "half stroke design". Half stroke design results in a lighter, faster more responsive piano action.

Figure 9:
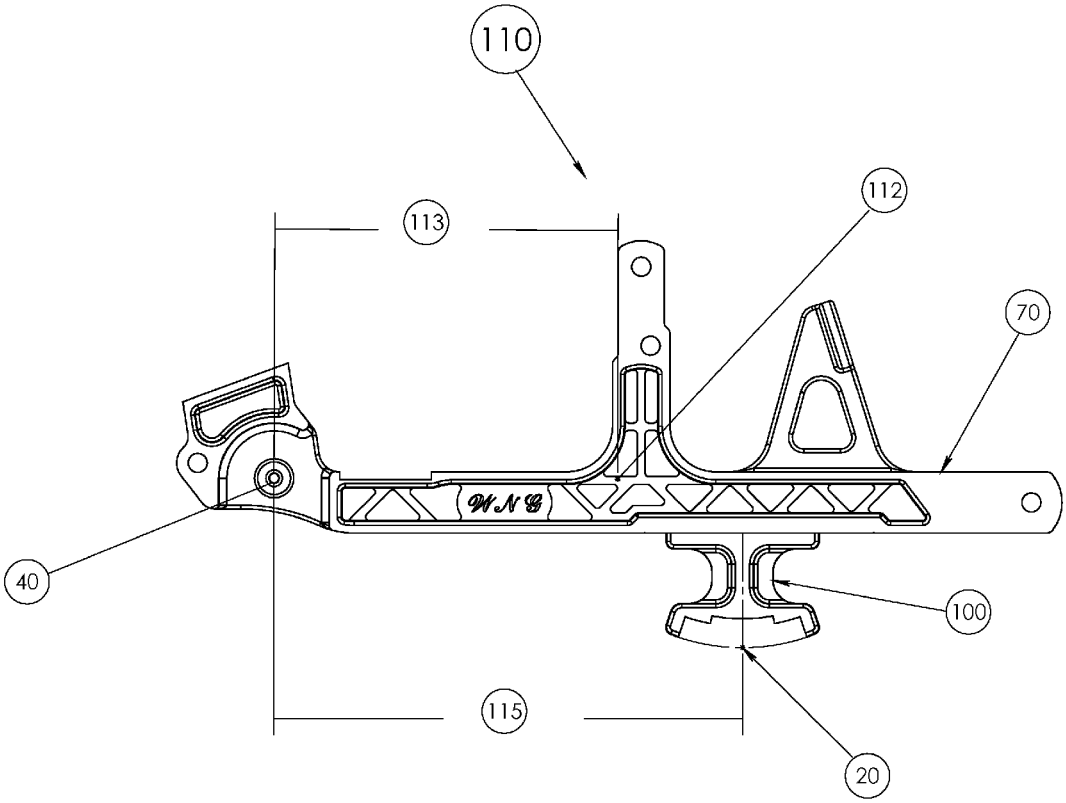
FIG. 9 is a side view of the Repetition Base with Moveable Multiple Height Heel.
Figure 10:
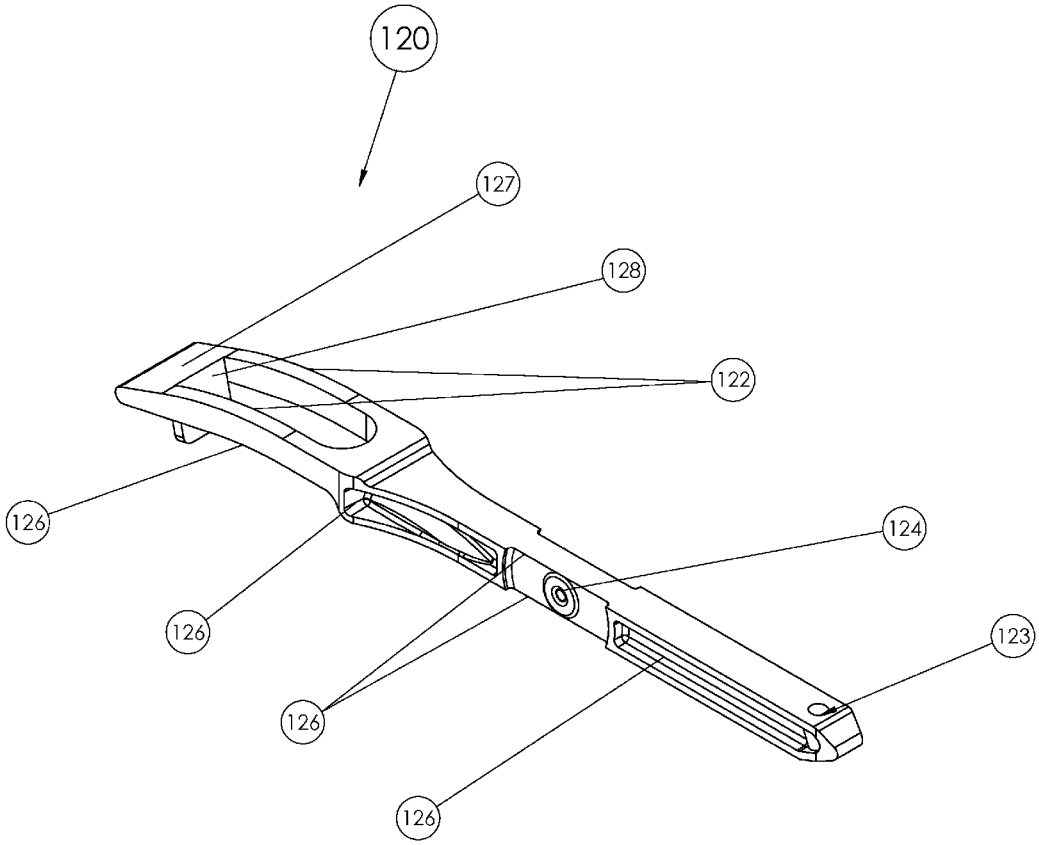
FIG. 10 is a perspective view of the Balancier.
Figure 11:
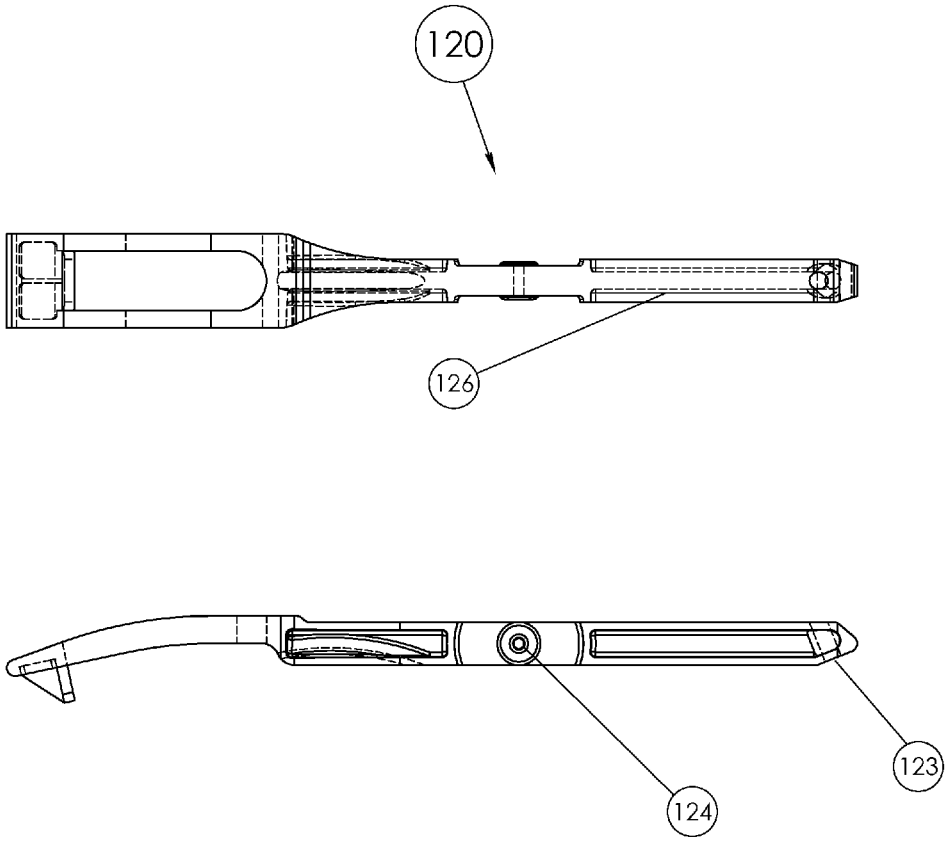
FIG. 11 is a top and side view of the Balancier.
Figure 12:
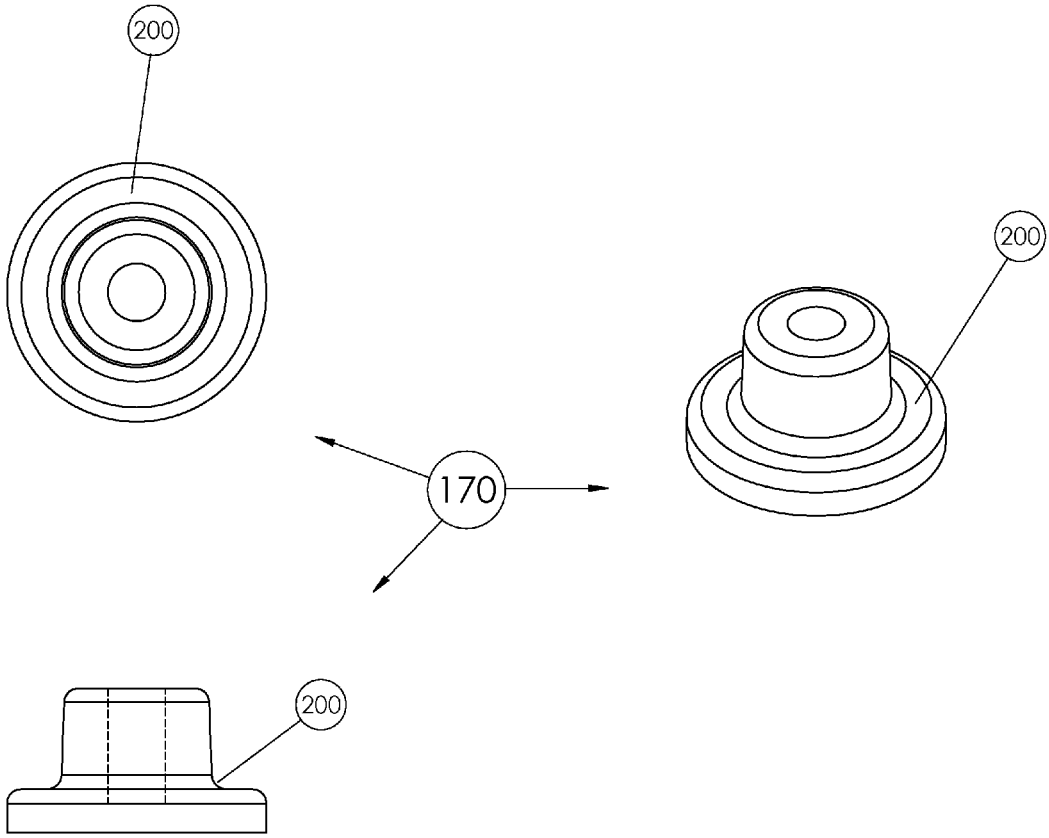
FIG. 12 provides multiple views of a Regulating Button.
Figure 13:
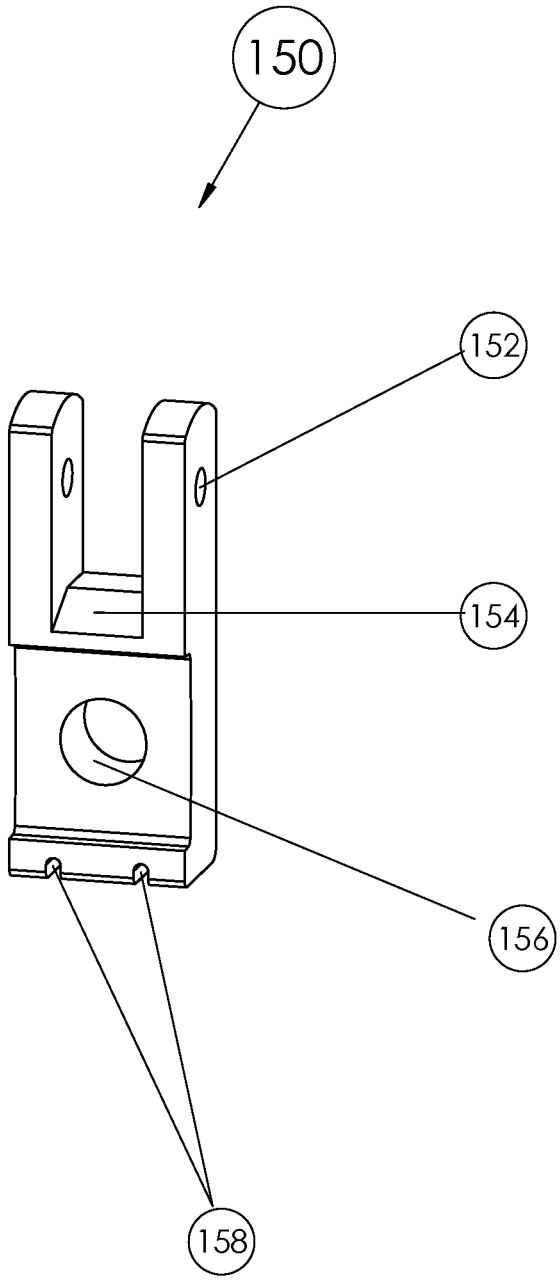
FIG. 13 is a perspective view of the Repetition Flange.
Figure 14:
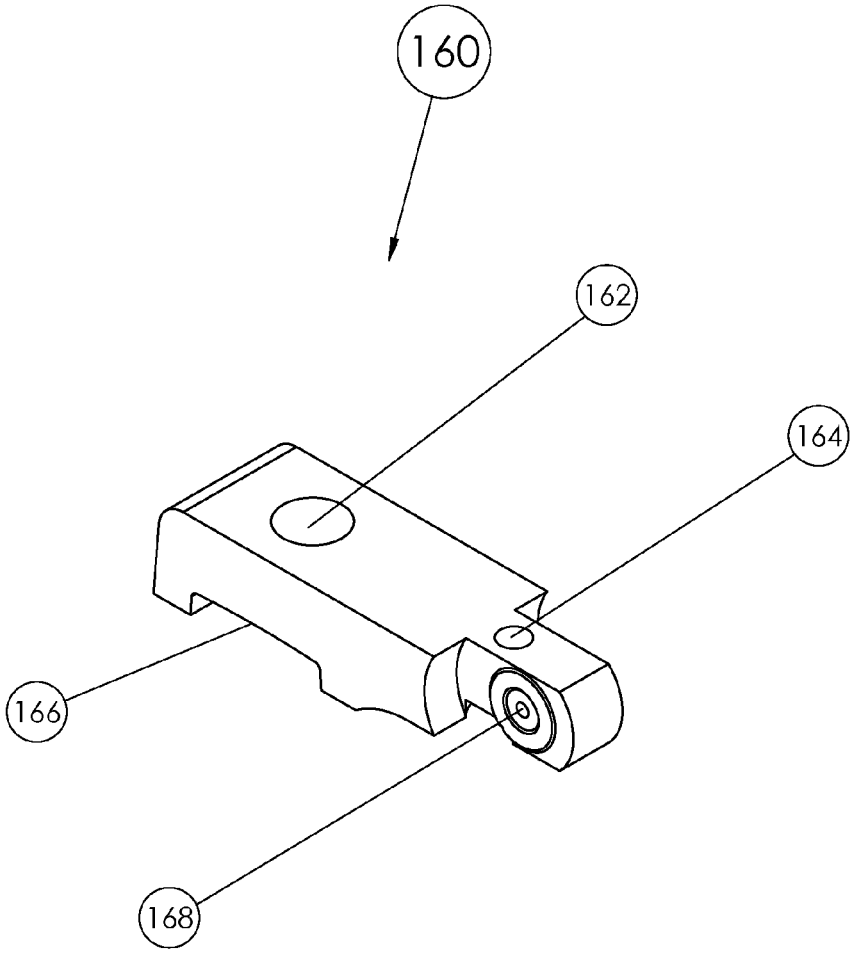
FIG. 14 is a perspective view of the Shank Flange.

A "half stroke line" is a theoretical line drawn from the 'Repetition center of rotation 40 to the capstan contact point 20' depicted by 115 (see FIG. 9) when the Repetition Assembly 30 is at half stroke, i.e. "when the key lifts the Repetition Base 70 exactly half way through the cycle boundaries of the Repetition Base". That line is then extended down beyond the Key center of rotation 60. This line is the "half stroke line".

Ideally, the half stroke line of each key intersects the balance point of that particular key. This is ideal because the key and the repetition both move in arcs and the slide path at the capstan will be minimized when the key balance points are in line. A key design with its balance point on the half stroke line will have less friction between the capstan and the heel. A reduction of friction at the capstan results in a lighter, faster, more responsive action.

Figure 15:
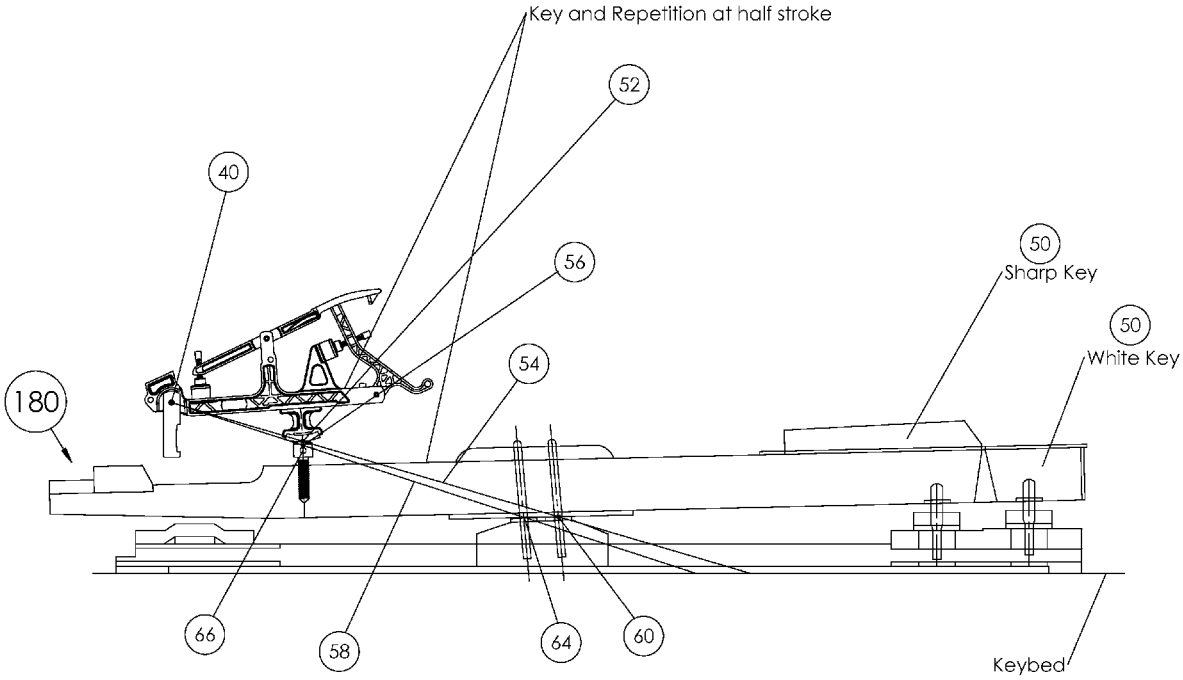
FIG. 15 is a side view depiction of the Half Stroke Line of a key.
Figure 16:
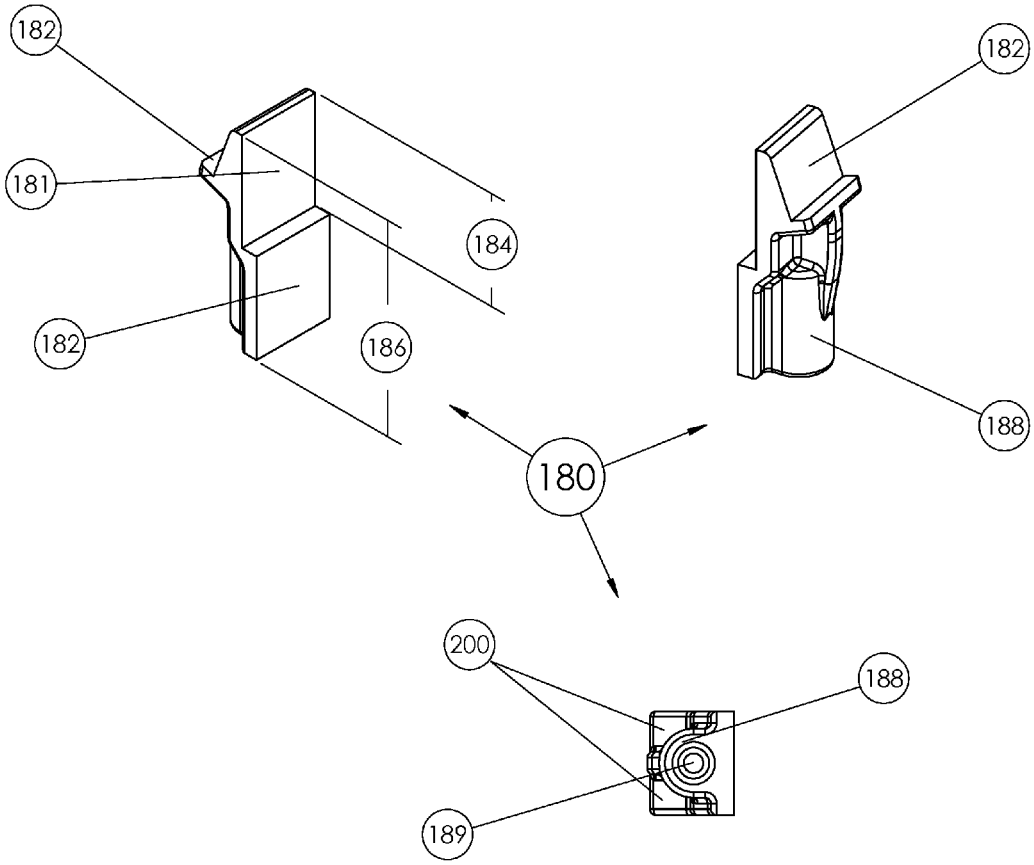
FIG. 16 provides multiple views of the Back Check.

However, simultaneous half stroke design on each key is not possible because the Repetition center of rotation (40), capstan contact point (20), and heel size are fixed. Keyboards are designed to half stroke line for the white key only. We ask the question why limit yourself here. In response, we have made a heel to allow variation of the repetition center of rotation (40) to capstan contact point (20) distance and height 117. This allows varying the capstan contact point 20 location with respect to the position of the key. This is depicted in FIG. 15 where one can see two half stroke lines. The sharp key half stroke line 58 runs through points 40 and 64. The white key half stroke line 54 runs through points 40 and 60. This is proper half stroke design.

One invention disclosed in this application is the first to provide near complete control for a keyboard designer to conduct a full half stroke setup on any grand piano. As discussed, half stroke design minimizes the slide path between the capstan and the repetition cushion and thus lowers friction. Additionally, because the friction does not need to be counterbalanced, less lead is required in the key. Thus, half stroke design also reduces mass in the system. The net result for the pianist is a faster more responsive action.

What is claimed is:

1. A repetition assembly for a grand piano comprising: a repetition base; a heel; a jack; a balancier; and a set of two regulating buttons, wherein: said repetition base is assembled to said balancer by a pin; said jack is assembled to said repetition base by a pin; one of said set of two regulating buttons is assembled to said jack by a rigid threaded member; the other of said set is assembled to said balancier by a rigid threaded member; said heel is attached to a lower base member of said repetition base by a calibrated adjustable connection system, comprising: at least one male notch (102) on the upper surface of said heel and a set of female notches (79) on the lower surface of said lower base member of said repetition base wherein said notches are appropriately sized so that said at least one male notch fits snuggly inside of any one of said set of female notches and the clearances between the adjacent connection surfaces of said notches is appropriate for connecting these members; and said repetition assembly is a mechanical action comprising three pivot points: a center-of-rotation of said repetition base, a center-of-rotation of said jack, and a center-of-rotation of said balancier, so that an upward force applied to the bottom surface of said heel causes said repetition assembly members to pivot about said pivot points, yielding a general upward motion of said jack.

2. A repetition assembly for a grand piano as recited in claim 1 wherein said set of female notches is a plurality of notches distributed along the lower surface of said lower base member of said repetition base to yield a range of heel connection locations so that when said at least one male notch is connected to any one of said set of female notches there exists a subassembly of said repetition base and said heel with a "repetition center-of-rotation to capstan contact point distance" (115) ranging from 12-20 millimeters inclusive.

3. A repetition assembly as recited in claim 2 wherein said repletion base and said heel are made of plastic or composite material.

4. A repetition assembly as recited in claim 3 wherein said repletion base and said heel are made of nylon plastic with 40-60% glass filler material.

* * * * *